United States Patent [19]

Hodge

[11] 3,990,629

[45] Nov. 9, 1976

[54] MAILBOX BRACKET

[76] Inventor: Joel W. Hodge, 208 Riverview Court, Elizabethton, Tenn. 37643

[22] Filed: Apr. 15, 1976

[21] Appl. No.: 677,508

[52] U.S. Cl. ..... 232/17; 40/125 R
[51] Int. Cl.[2] ..... B65D 91/00
[58] Field of Search ..... 232/17; 40/125; 248/223, 229, 310, 311 R

[56] References Cited

UNITED STATES PATENTS

| | | | |
|---|---|---|---|
| 2,519,525 | 8/1950 | White | 232/17 X |
| 2,607,141 | 8/1952 | Petersen | 232/17 X |
| 2,872,103 | 2/1959 | Heard | 232/17 X |
| 2,976,633 | 3/1961 | Squire | 232/17 X |

*Primary Examiner*—Roy D. Frazier
*Assistant Examiner*—Peter A. Aschenbrenner
*Attorney, Agent, or Firm*—Donald R. Cassady; R. Laddie Taylor

[57] ABSTRACT

A bracket for attaching a sign or box to a mailbox of conventional design having a door at one end and a panel at the other, said panel terminating in a bead coplanar with the panel, such bracket comprising a bar adapted to lie in contact with the top of the box, a first fastening member at one end of the bar comprising a slot adapted to pass over the upper snap bar of the mailbox and a second fastening means at the other end comprising a V-shaped assemblage of bars attached to the aforesaid bar at the apex of the V and at right angles thereto and having inturned sides near the open end of the V adapted to pass over the bead of the mailbox, said V-shaped assemblage of bars adapted to lie in contact with the mailbox end and of such length that the bars co-act with the bead at a point below the curved portion of the mailbox end.

4 Claims, 4 Drawing Figures

MAILBOX BRACKET

BACKGROUND OF THE INVENTION

The field of art for which this invention relates is that pertaining to a method for attaching a newspaper delivery box or nameplate to the conventional, approved, rural delivery mailbox.

Particularly, this invention pertains to a bracket for attaching such nameplate or newspaper box to the mailbox. Prior brackets, as discussed in U.S. Pat. Nos. 2,607,141; 2,615,267; and 2,976,633, provides a plate or similar attaching device, but these devices do not lock securely to the mailbox to provide a stable foundation. This is particularly important if a newspaper box is to be attached to the bracket since, in common use, there will be considerable stress exerted on the newspaper box and through the newspaper box into the bracket. Customarily, said brackets are found to be bent and broken by constant usage or easily slipped from the mailbox by careless insertion or removal of a newspaper.

SUMMARY OF THE INVENTION

The bracket of this invention comprises a substantially flat metal strip or bar substantially co-terminus with the ends of the rural mailbox terminating at one end with a slot or rectangular hole adapted to pass over the snap bar of the mailbox but not of such length as to interfere with the normal opening and closing of the mailbox. The second fastening means at the other end of the bar is a V-shaped assemblage of metal strips or bars attached at the apex at right angles to the first strip and having inturned sides near the open end adapted to pass over the bead of the mailbox. The V-shaped assemblage shall lie substantially parallel to and in contact with the rear panel of the mailbox.

DETAILED DESCRIPTION OF THE DRAWINGS

In order to more clearly disclose the construction, operation, and use of the invention, reference should be made to the accompanying drawings forming part of the invention. Throughout the several views in the drawings, like reference characters designate the same parts.

Figure 1:
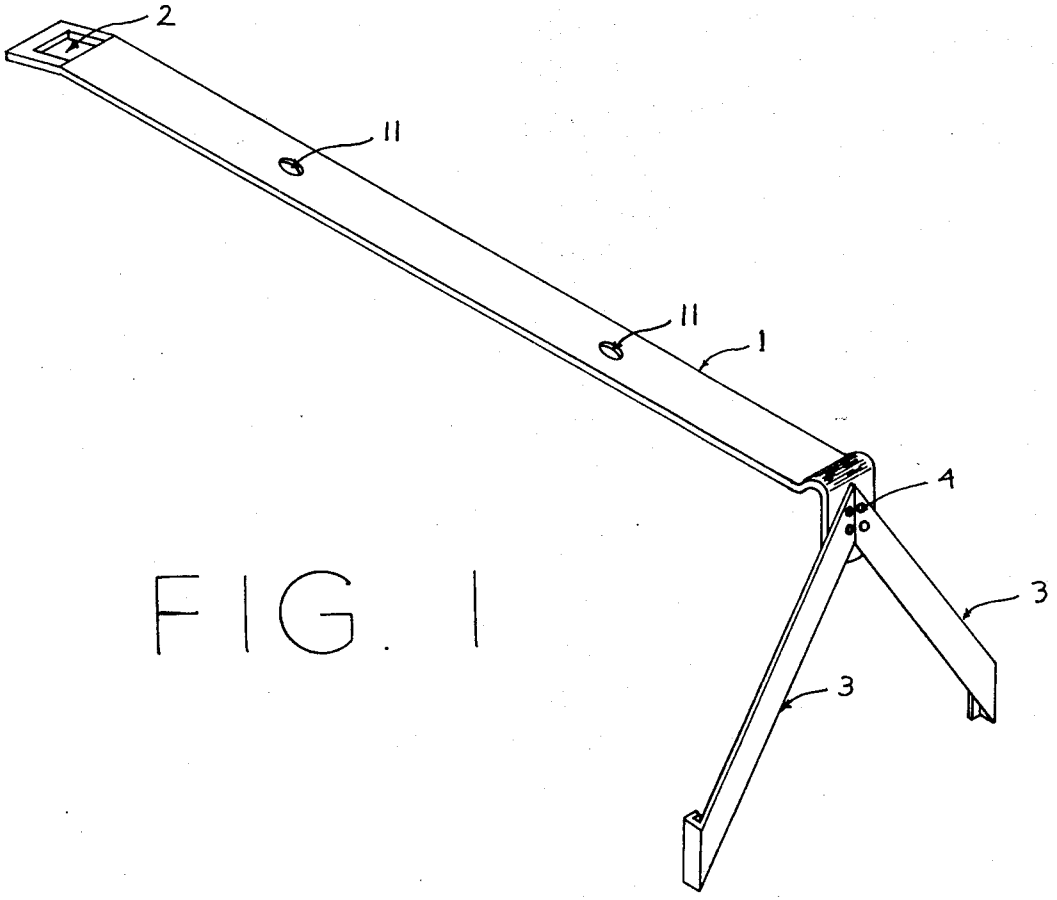
FIG. 1 is a perspective view of the bracket of this invention adapted particularly to attaching nameplate thereto.
Figure 2:
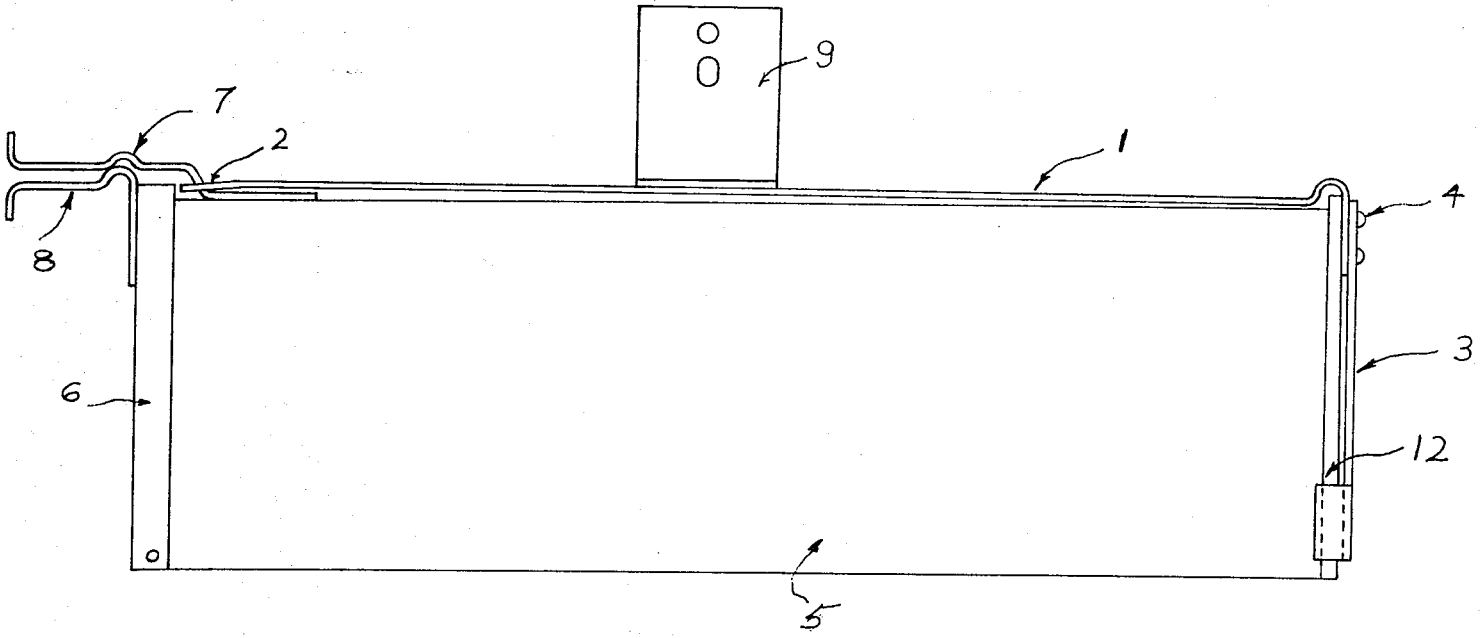
FIG. 2 is a side view of a mailbox with the bracket of this invention attached thereto, said bracket being adapted to contain a L-shaped panel thereupon, said panel being particularly adapted to the attachment of a newspaper box to the bracket.
Figure 4:
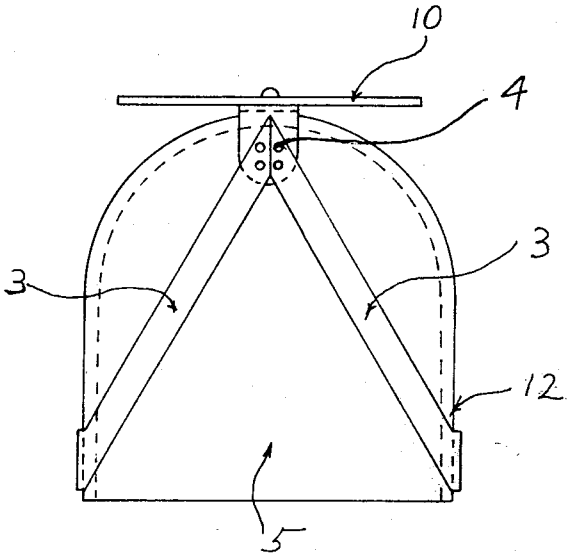
FIG. 4 is an end view of the box and the bracket of the present invention adapted to contain a flat panel thereupon, said panel being particularly adapted to attach a newspaper box thereto.
Figure 3:
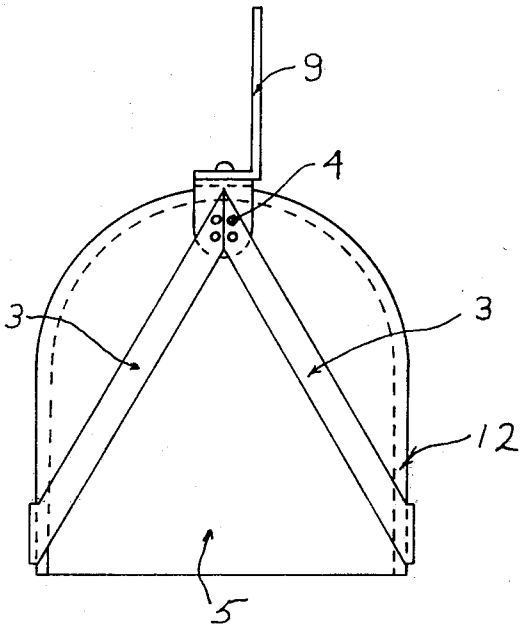
FIG. 3 is an end view of the box with the bracket of the present invention attached thereto, said bracket being adapted as shown in FIG. 2.

Turning now to the description of the drawings by reference characters, there is shown a conventional mailbox 5. Such mailboxes are of a highly standardized design with the back panel of the mailbox attached to the side and the floor mailbox in the form of a bead as by a conventional metal forming operation. The bead is co-planar with the end panel of the mailbox. The front of the box has a door 6 to which is attached a lower snap bar 8. Upon closing the box, this lower snap bar 8 meshes with an upper snap bar 7 which is fastened to the top of the box. It will be noted that the upper snap bar 7 is attached to the box at a point some distance back from the edge of the box.

In accordance with this invention, a bracket is provided of suitable configuration to attach securely to the mailbox without drilling or otherwise defacing the box.

Such bracket consists of a substantially flat metal bar 1 adapted to lie parallel to and in contact with the upper surface of the box. The bracket is substantially co-terminus with the ends of the mailbox with one end containing a slot or rectangular hole 2 adapted to pass over the upper snap bar 7 and the other end firmly attached by fastening means 4 to a V-shaped assemblage of bars 3 which lie parallel to and in contact with the end panel of the mailbox. At a point substantially below the curved portion of the side of the mailbox the bars 3 are inwardly turned to co-act with the bead 12 of the mailbox firmly attaching the bars 3 to the mailbox 5.

The bracket can be adapted for attaching a sign or nameplate by drilling one or more holes 11 through the upper bracket as rivet holes or screw holes or can be adapted to attach a newspaper box thereto by the attachment of a flat panel 10 or L-shaped panel 9 thereto.

Preferably, the upper bar 1 may contain a slight offset to contain the upper portion of the bead of the rear panel at the point just prior to the point of attachment of the V-shaped assemblage of bars at the rear end of the box.

The bracket of the present invention can be fabricated of metal or plastic. It is obvious to one skilled in the art if a metal is used, care must be taken that corrosion does not occur defacing both the bracket and the mailbox. This can be provided by using aluminum; by hot dip galvanizing steel, if it is used; or by covering the metal bracket with a plastic coating.

I claim:

1. A bracket for attaching a sign or box to a mailbox of conventional design having a door at one end and a panel at the other, said panel terminating in a bead co-planar with the panel, such bracket comprising a bar adapted to lie in contact with the top of the box, a first fastening member at one end of the bar comprising a slot adapted to pass over the upper snap bar of the mailbox and a second fastening means at the other end comprising a V-shaped assemblage of bars attached to the aforesaid bar at the apex of the V and at right angles thereto and having inturned sides near the open end of the V adapted to pass over the bead of the mailbox, said V-shaped assemblage of bars adapted to lie in contact with the mailbox end and of such length that the bars co-act with the bead at a point below the curved portion of the mailbox end.

2. A bracket of claim 1 adapted to attach a sign thereto wherein said bracket contains at least one hole on the bar adapted to lie in contact with the top of the box.

3. A bracket according to claim 1 wherein the bracket is adapted to attach a box thereto, such bracket having a flat metal panel attached to the bar adapted to lie in contact with the top of the box and co-planar therewith.

4. A bracket according to claim 1 wherein the bracket is adapted to attach a box thereto, such bracket having an L-shaped metal panel, the base of which is attached to the bar adapted to lie in contact with the top of the box.

* * * * *